US006293720B1

(12) United States Patent
Zahn

(10) Patent No.: US 6,293,720 B1
(45) Date of Patent: Sep. 25, 2001

(54) PENCIL HAVING AN AXIALLY-MOVEABLE CORE, PARTICULARLY A SOFT-CORE PENCIL

(75) Inventor: Werner Zahn, Geroldsgrün (DE)

(73) Assignee: A.W. Faber-Castell Unternehmensverwaltung GmbH & Co., Stein (DE)

( * ) Notice: Subject to any disclaimer, the term of this patent is extended or adjusted under 35 U.S.C. 154(b) by 0 days.

(21) Appl. No.: 09/306,759

(22) Filed: May 7, 1999

(30) Foreign Application Priority Data

May 7, 1998 (DE) ..... 198 20 288

(51) Int. Cl.[7] ..... B43K 21/08
(52) U.S. Cl. ..... 401/75; 401/78
(58) Field of Search ..... 401/75, 77, 78, 401/68, 55

(56) References Cited

U.S. PATENT DOCUMENTS

| | | | | |
|---|---|---|---|---|
| 1,489,765 | | 4/1924 | Jones . | |
| 2,336,328 | | 12/1943 | Whalen . | |
| 2,720,863 | | 10/1955 | Rey et al. . | |
| 3,310,168 | * | 3/1967 | Landen | 401/78 |
| 5,076,720 | * | 12/1991 | Roger | 401/75 |
| 5,813,421 | * | 9/1998 | Wang | 401/75 |
| 5,842,802 | * | 12/1998 | Lang et al. | 401/75 |
| 5,888,004 | * | 3/1999 | Bouix | 401/75 |

FOREIGN PATENT DOCUMENTS

| | | | | |
|---|---|---|---|---|
| 921860 | * | 5/1947 | (FR) | 401/77 |
| 2438986 | * | 9/1980 | (FR) | 401/75 |
| WO 96/18323 | | 6/1996 | (WO) . | |

* cited by examiner

*Primary Examiner*—Charles R. Eloshway
(74) *Attorney, Agent, or Firm*—Venable; Robert Kinberg; Catherine M. Voorhees

(57) ABSTRACT

A pencil having an axially-movable core, particularly a soft-core pencil, for example a cosmetic pencil. The pencil has a sleeve-shaped pencil body with a core opening on the side of the tip, a core-driving part that holds the core and is seated to be axially movable in the pencil body, and a rotating sleeve that is disposed coaxially to the core and the pencil body is seated to be rotatably and axially fixed and cooperates directly or indirectly with the core-driving part in the manner of a spindle gear. At least one longitudinal section of the rotating sleeve that is remote from the tip is surrounded by the pencil body. Also, the circumferential wall of the pencil body that surrounds the rotating sleeve has at least one actuation window, and the rear end of the core is inserted so as to be rotatably and axially fixed into a front section of the core-driving part that is embodied as a core-retaining part having a tube-section shape. The outer circumferential surface of the core-retaining part cooperates with the inner surface of the rotating sleeve in the manner of an axial guide.

19 Claims, 8 Drawing Sheets

PENCIL HAVING AN AXIALLY-MOVEABLE CORE, PARTICULARLY A SOFT-CORE PENCIL

CROSS-REFERENCE TO RELATED APPLICATION

This application claims the priority of Patent Application Serial No. 198 20 288.1 filed in Germany on May 7, 1998.

BACKGROUND OF THE INVENTION

The present invention relates to a pencil having an axially-movable core, particularly a soft-core pencil, for example a cosmetic pencil. Pencils of this type have a sleeve-shaped pencil body with a front core opening, in which a core-driving part that holds the core is seated to move axially. In the known pencils, the pencil body comprises a shaft and a rotating sleeve that is rotatably connected to the shaft and forms the front part of the pencil body. The rotating sleeve is connected directly or indirectly to the core-driving part in the manner of a spindle drive. The core can be moved out of the core opening and back into it due to a relative rotation between the rotating sleeve and the shaft.

Typically, a protective cap that completely receives the rotating sleeve can be placed onto the shaft of such pencils. A pencil of this type, described in, for example, WO 96/18323, is disadvantageous in terms of handling. First, when the protective cap is removed, the core can easily be moved out of the core opening and may be broken off or deformed due to an accidental relative rotation between the shaft and the rotating sleeve. Likewise, in the application of an eyeliner pencil, an undesired relative rotation between the shaft and the front part is entirely possible, at least if the pencil is carelessly handled. Furthermore, relative rotation can occur between the shaft and the rotating sleeve even if the protective cap is in place. If, during a rotation of the protective cap, the cap is additionally bent transversely to the longitudinal axis of the pencil, the front part can be carried along by the rotating protective cap due to a frictional lockup, and the core can be pressed against the bottom of the cap and thus deformed. Moreover, in the conventional pencils, the rotatable connection between the front part and the shaft must be relatively stable, and therefore structurally complex, to assure the overall rigidity of the pencil. This connection often loosens over the service life of the pencil.

U.S. Pat. Nos. 1,489,765 and 2,336,328 disclose pencils in which the core can be moved out of an opening of the pencil body by a rod-shaped driving part that is axially seated in the pencil body and has an outside thread. The outside thread engages the inside thread of a drive nut that is axially fixedly seated in the pencil body and is accessible by way of an actuation window in the pencil body. In a pencil such as is shown in U.S. Pat. No. 2,720,863, the rear end of the core is seated in a core-retaining part, which has the shape of a tube section and is in turn inserted to be axially movable into a guide sleeve. The guide sleeve has a longitudinal slot through which radial protrusions of the core-retaining part project. The radial protrusions engage the inside thread of a drive nut that radially surrounds the guide sleeve. An actuating section of the drive nut projects beyond the circumference of the pencil body, and divides it into two sections, namely a shaft section and a tip section.

It is therefore the object of the present invention to provide a pencil of the type mentioned above, having an alternative construction and a particularly simple design, and small radial dimensions.

BRIEF DESCRIPTION OF THE INVENTION

This object is accomplished by a pencil having an axially-moveable core particularly a soft-core pencil, having a sleeve-shaped pencil body with a core opening on the side of the tip, a core-driving part that holds the core and is seated to be axially moveable in the pencil body, and a rotating sleeve that is disposed coaxially to the core (3) and the pencil body, and is seated to be rotatably and axially fixed, and cooperates directly or indirectly with the core-driving part in the manner of a spindle gear. At least one longitudinal section of the rotating sleeve that is remote form the tip is surrounded by the pencil body, the circumferential wall of the pencil body (1) that surrounds the rotating sleeve (2) has at least one actuation window, and the rear end of the core is inserted so as to be rotatably and axially fixed into a front section of the core-driving part that is embodied as a core-retaining part having a tube section shape, with the outer circumferential surface of the core-retaining part cooperating with the inner surface of the rotating sleeve in the manner of an axial guide.

In contrast to conventional pencils, the rotating sleeve is essentially disposed entirely inside the pencil body, and the circumferential wall of the pencil body that surrounds the core is provided with at least one actuation window. This ensures, on the one hand, that the pencil body can be embodied in one piece, assuring the aforementioned rigidity. The rotating sleeve that is rotatably and axially fixed in the pencil body is accessible by way of the at least one actuation window. The pencil body surrounds at least one longitudinal section of the rotating sleeve that is remote from the tip. The rear end of the core is seated, so as to be rotatably and axially fixed, in a front core-retaining part embodied as a tube section; the outer circumferential surface of the core-retaining part cooperates with the inner surface of the rotating sleeve in the manner of an axial guide. This embodiment assures, on the one hand, a simple design and, correspondingly, easy assembly. On the other hand, this embodiment permits a reduction in the radial dimensions of the pencil, which is especially advantageous for pencils having thick cores, such as lip liner pencils.

The rotating sleeve is preferably disposed completely inside the pencil body, which reduces the danger of an undesired advancing of the core.

In a preferred embodiment, the actuation window is disposed in the front section of the pencil body. In addition to the associated structural advantages with respect to the arrangement of the core drive in the rear section of the pencil body, the pencil is also advantageous in terms of handling. Specifically, the actuation window serves additionally as a finger grip. If the rotating sleeve is disposed completely inside the pencil body, as described above, this prevents an undesired advancing of the core through a relative rotation between the pencil body and a pencil cap placed on the front end of the pencil.

Another advantageous feature of the present invention is that the rotating sleeve at least partially comprises a transparent material in the region of the actuation window, so that the core is visible. This has the advantage of omitting the need for identifying the core color on the pencil body, for example through the provision of a sealing plug having the same color as the core. The transparent region also serves as an indicator of how much of the core has been used. Further advantageous embodiments, particularly with respect to the core drive, ensue from the following description of the invention.

BRIEF DESCRIPTION OF THE DRAWINGS

The invention is described below by way of embodiments illustrated in the drawings, which incorporate the figures described below.

DETAILED DESCRIPTION OF THE PREFERRED EMBODIMENTS

Figure 1:
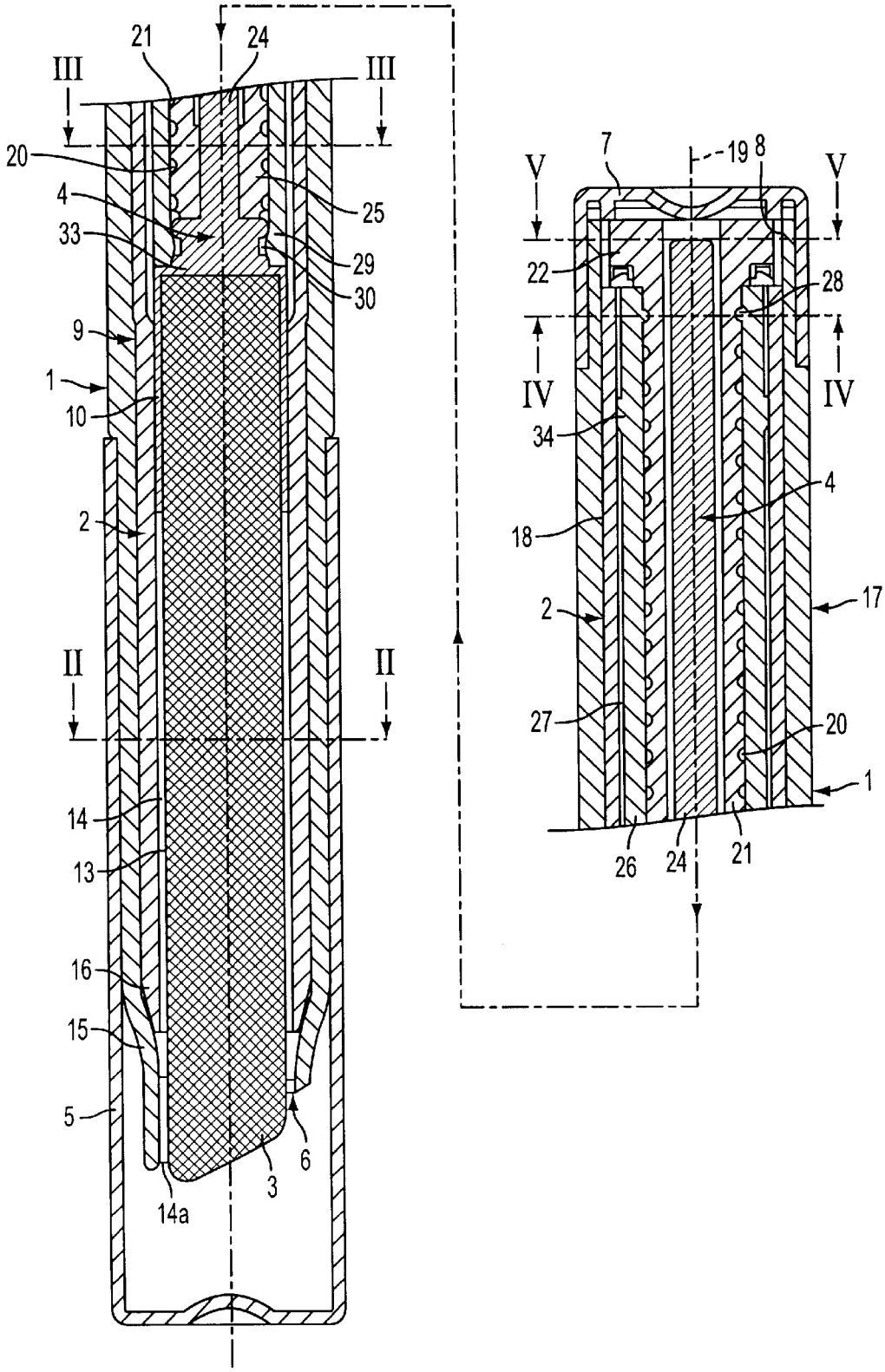
FIG. 1 is a longitudinal section through a first embodiment of a pencil.
Figure 2:
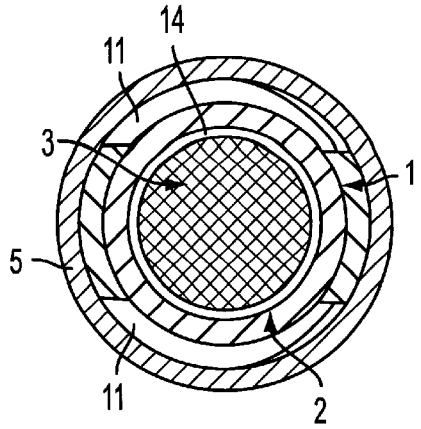
FIG. 2 is a cross-section along the line II—II in FIG. 1.

FIG. 1 shows a lip liner pencil in a longitudinal section, the pencil having, in common with the other embodiments - the primary components of a pencil body 1, a rotating sleeve 2, a core 3, a core-driving part 4 and a protective cap 5. The sleeve-shaped pencil body 1 has a core opening 6 at its front end. The rear end of the pencil body 1 is sealed by a sealing plug 7. The rotating sleeve 2 is rotatably and axially fixed inside the pencil body 1, with the inner surface of the pencil body 1 cooperating with the outer surface of the rotating sleeve 2 in the manner of a sliding coupling. On one side, the rotating sleeve 2 extends nearly to the core opening 6, and ends at the other side at a distance from the front end of the pencil body. The rotating sleeve is fixed in the axial direction, on the one hand, by an apron 8 of the sealing plug, which projects into the pencil body, and against which the rear end face of the rotating sleeve 2 rests. At the location indicated by reference numeral 9, the pencil body 1 and the rotating sleeve 2 cooperate with two radial shoulders in the manner of a stop with respect to the core opening 6. The core-driving part 4 is disposed coaxially inside the rotating sleeve 2. The front part of the core-driving part 4 is embodied as an essentially tubular core-retaining part 10, in which the rear section of the core 3 is rotatably and axially fixed; the circumferential surface 13 of the core ends flush with the inner surface of the core-retaining part 10. The outer surface of the core-retaining part 10 rests against the inner surface of the rotating sleeve 2, and cooperates with this outer surface in the manner of an axial guide. The same applies for the embodiments described below. A radial gap 14 is therefore present between the core section projecting from the core-retaining part 10 and the rotating sleeve. The end region 15 of the pencil body 1 narrows radially. A radial gap 14*a* is likewise present between its inner surface and the circumferential surface 13 of the core. The inside diameter of the end region 15 corresponds to the inside diameter of the section of the rotating sleeve that surrounds the core. The radial gaps 14, 14*a* therefore have the same gap width. The transition to the end region 15 is chamfered. A flattened region 16 of the rotating sleeve 2 that is inclined toward the core rests against the chamfered region. This assures an additional axial fixing of the rotating sleeve 2 in the direction of the core opening 6.

Figure 3:
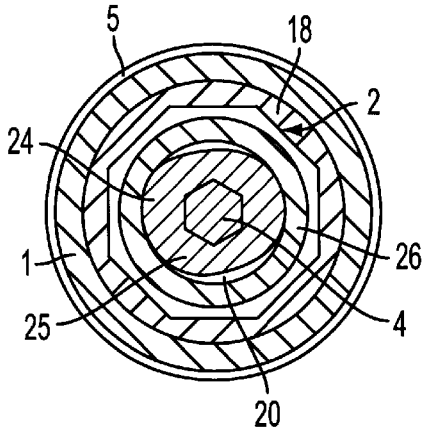
FIG. 3 is a cross-section along the line III—III in FIG. 1.
Figure 4:
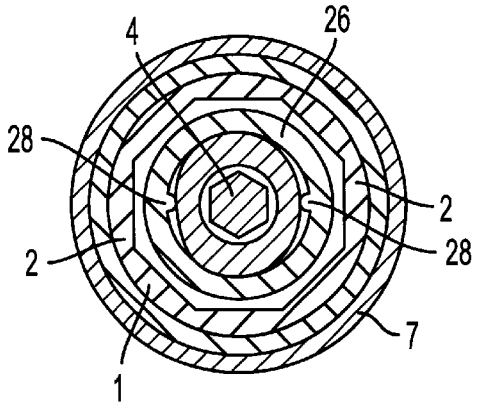
FIG. 4 is a cross-section along the line IV—IV.
Figure 5:
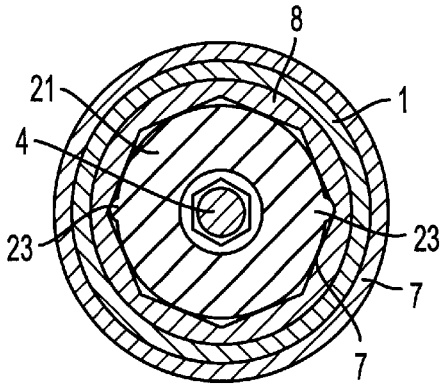
FIG. 5 is a cross-section along the line V—V.

As mentioned above, a drive section 18 of the rotating sleeve 2 extends into the rear section 17 of the pencil body. Also disposed in the rear section 17 is an essentially hollow-cylinder-shaped threaded spindle 21 that is fixed in the axial direction and the direction of rotation and extends coaxially to the center longitudinal axis 19 of the pencil body 1, and has an outside thread 20. The threaded spindle 21 widens radially at its rear end to form a form-fit section 22, and is surrounded, tightly or with a form-fit, by the inner surface of the apron 8 of the sealing plug 7, which has an octagonal cross section. Two diametrically-opposite latching protrusions 23 project from the circumferential surface and extend into diametrically-opposite corners of the inner surface of the apron 8 (FIG. 5). With this embodiment, the threaded spindle 21 is fixed in both the axial direction and the direction of rotation in the pencil body 1. A central guide rod 24 is formed onto the rear end of the core-retaining part 10, this guide rod 24 extending into the hollow-cylinder-shaped threaded spindle 21 with radial spacing and nearly up to the rear end of the spindle 21. The guide rod 24 has a hexagonal cross section, and is surrounded with torsional lockup by the inner surface of the front end 25 of the threaded spindle 21, the surface also being hexagonal (FIG. 3). A connecting sleeve 26, whose inner surface cooperates with the outer circumferential surface of the threaded spindle 21 in the manner of a sliding coupling, is disposed between the threaded spindle 21 and the drive section 18 of the rotating sleeve 2, there being a radial gap 27 between the outer circumferential surface of the connecting sleeve and the inner surface of the rotating sleeve. Two diametrically-opposite and radially inward-oriented protrusions 28 disposed at the rear end of the connecting sleeve engage the outside thread 20 of the threaded spindle 21. At the front end of the connecting sleeve 26, an annular protrusion 29 projects radially inward from the inner surface of the sleeve. This annular protrusion 29 latches in a circumferential annular groove 30 in the circumferential surface of a fixing section 33 that has the shape of a circle segment and is disposed between the guide rod 24 and the core-retaining part 10. The connecting sleeve 26 is guided inside the drive section 18 to be rotatably fixed and axially movable. To fix the connecting sleeve 26 with respect to rotation, the inner surface of the drive section 18 has an octagonal cross section and surrounds a radially-widened longitudinal section 34 of the connecting sleeve 26, with a torsional lockup, the section being disposed near the rear end of the connecting sleeve 26 and likewise having a rectangular cross section.

To cause axial movement of the core 3, the rotating sleeve 2 is rotated relative to the pencil body 1 in the region of the diametrically-opposite actuation windows 11.

Due to the torsional interlock between the drive section 18 of the rotating sleeve 2 and the longitudinal section 34 of the connecting sleeve 26, the latter co-rotates in the same direction. Because the protrusions 28 engage the outside thread 20 of the threaded spindle 21, the connecting sleeve 26 is moved axially depending on the direction of rotation of the rotating sleeve, starting from the position illustrated in FIG. 1, that is, for example, forward in the direction of the core opening 6. The core is therefor pushed out of the core opening. Due to the rotational fixing between the guide rod 24 and the threaded spindle 21 disposed, fixed against relative rotation, in the pencil body 1, the core is rotatably fixed with respect to the pencil body 1 or the core opening 6. The rotating sleeve 2 therefore performs a relative rotation with respect to the core 3. The radial gap 14 between the circumferential surface 13 of the core 3 and the rotating sleeve, and the radial gap 14*a* between the core and the inner surface of the end region 15 of the pencil body 1, prevent shearing of the core 3. The rotating sleeve 2 comprises a transparent material, so the color of the pencil is identifiable from the outside, even if the core 3 is completely recessed into the pencil body 1. The core-retaining part 10 is also visible from the outside, so the core consumption can be checked simply.

Figure 6:
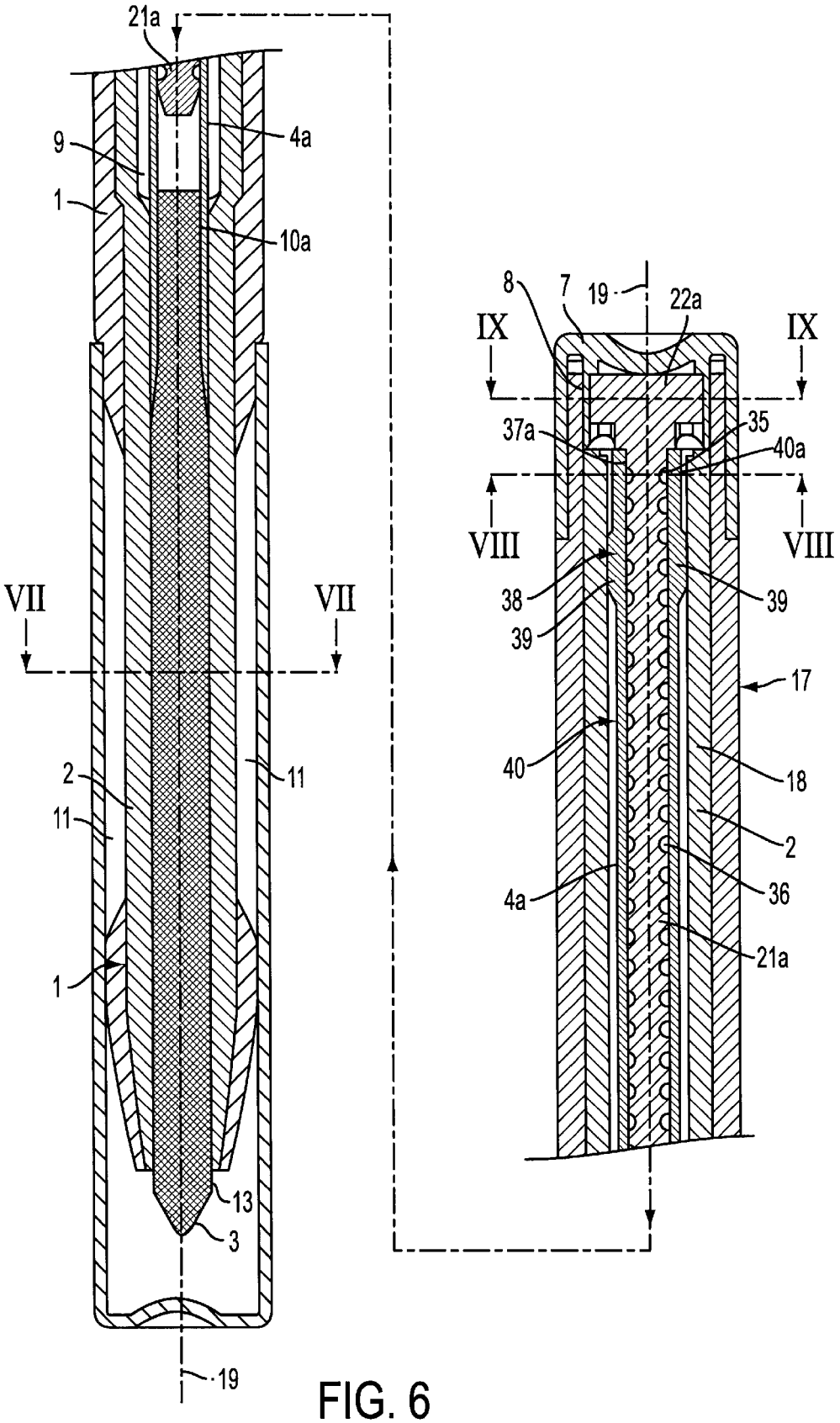
FIG. 6 is a longitudinal section through a further embodiment of a pencil.
Figure 7:
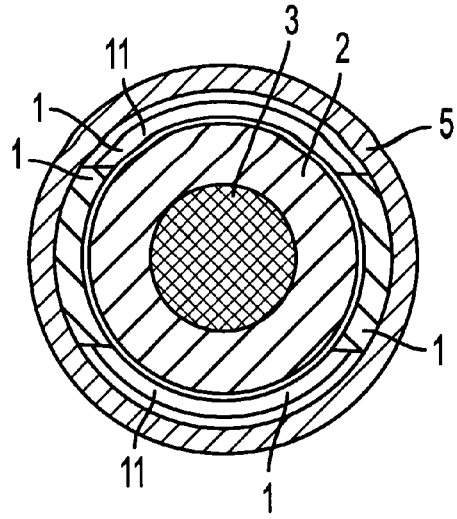
FIG. 7 is a cross-section along the line VII—VII in FIG. 6.
Figure 8:
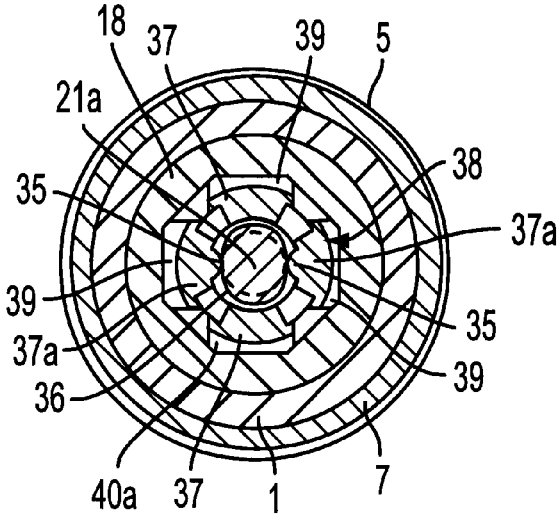
FIG. 8 is a cross-section along the line VIII—VIII in FIG. 6.
Figure 9:
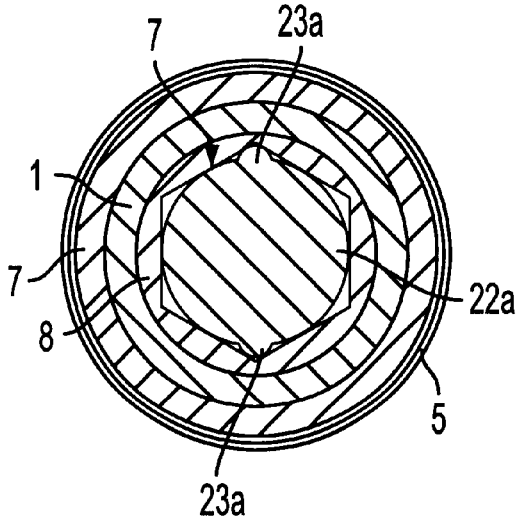
FIG. 9 is a cross-section along the line IX—IX in FIG. 6.

FIG. 6 shows a cosmetic pencil in which the rotating sleeve 2 likewise extends with a drive section 18 into the rear section 17 of the pencil body and nearly up to the rear end of the pencil body. In contrast to the lip liner pencil shown in FIGS. 1 through 5, the core-driving part 4*a* is essentially tubular, and rotatably fixed in the rotating sleeve 2 and guided to be moved axially. Due to the rotatably-fixed arrangement between the core-driving part 4*a* and the rotating sleeve 2, a shearing off of the core 3 during its axial movement is precluded from the outset. Accordingly, no radial gap is present between the circumferential surface 13 of the core 3 and the inner surface of the front part of the rotating sleeve 2. The diameter 3 of the core corresponds to the outside diameter of the core-retaining part 10*a*. In other words, the circumferential surface 13 of the core 3 ends flush with the outside circumferential surface of the core-retaining part 10*a*. The core-driving part 4*a* coaxially surrounds a threaded spindle 21*a* that is fixed in the axial direction and the direction of rotation in the rear section 17 of the pencil body 1, and engages the spindle in the manner of a core-driving part 4*a* gear. To this end, the spindle has at its rear end two diametrically-opposite protrusions 35, which project radially inward and engage the thread 36 of the threaded spindle 21*a*. The rear end of the core-driving part 4*a* has longitudinal slots, thereby forming four diametrically-opposite pairs of spring tongues 37, 37*a*. Two of the spring tongues 37*a* of a diametrically-opposite spring-tongue pair respectively support a protrusion 35. The spring tongues 37*a* assure a so-called over-ratchet function. As can be seen particularly in FIG. 9, the threaded spindle 21*a* is rotatably and axially fixed inside the pencil body 1 in the same manner as in the pencil described in FIG. 1. The apron 8 of the sealing plug 7 is also provided with a polygonal, namely a hexagonal, inside cross section. The threaded spindle 21*a* also has at its rear end a radially-widened form-fit section 22*a*, with two latching protrusions 23*a* protruding radially outward from the circumferential surface of this section and extending into diametrically-opposite corners of the apron 8 having a hexagonal inner surface (FIG. 9). The rear end of the tubular core-driving part 4*a* is connected with torsional lockup to the drive section 18 of the rotating sleeve 2. To this end, the inner surface of the drive section 18 of rotating has an octagonal cross section. A longitudinal section 38 disposed at a distance in front of the rear end of the driving section 18 of rotating sleeves has four radially outward-projecting form-fit protrusions 39, which are disposed diametrically opposite one another in pairs and inserted with a form-fit into the octagonal inner contour of the drive section 18. A radial gap 40 is present between the region of the drive section 18 that extends from the longitudinal section 38 to adjoin the core-retaining part 10*a* and the core-driving part 4*a*. A radial gap 40*a* is also present between the spring tongues 37, 37*a* and the end region of the drive section 18. The spring tongues 37, 37*a* can be deflected radially outward through the radial gap 40*a*, thereby assuring the over-ratchet function of the coredriving part 4*a*.

During a relative rotation between the rotating sleeve 2 and the pencil body 1, the core-driving part 4*a* is displaced axially forward, in the direction of the core opening 6, because of its torsional-lockup connection with the drive section 18, for example based on the situation illustrated in FIG. 6. No relative rotation occurs between the core 3 and the rotating sleeve 2.

Figure 10:
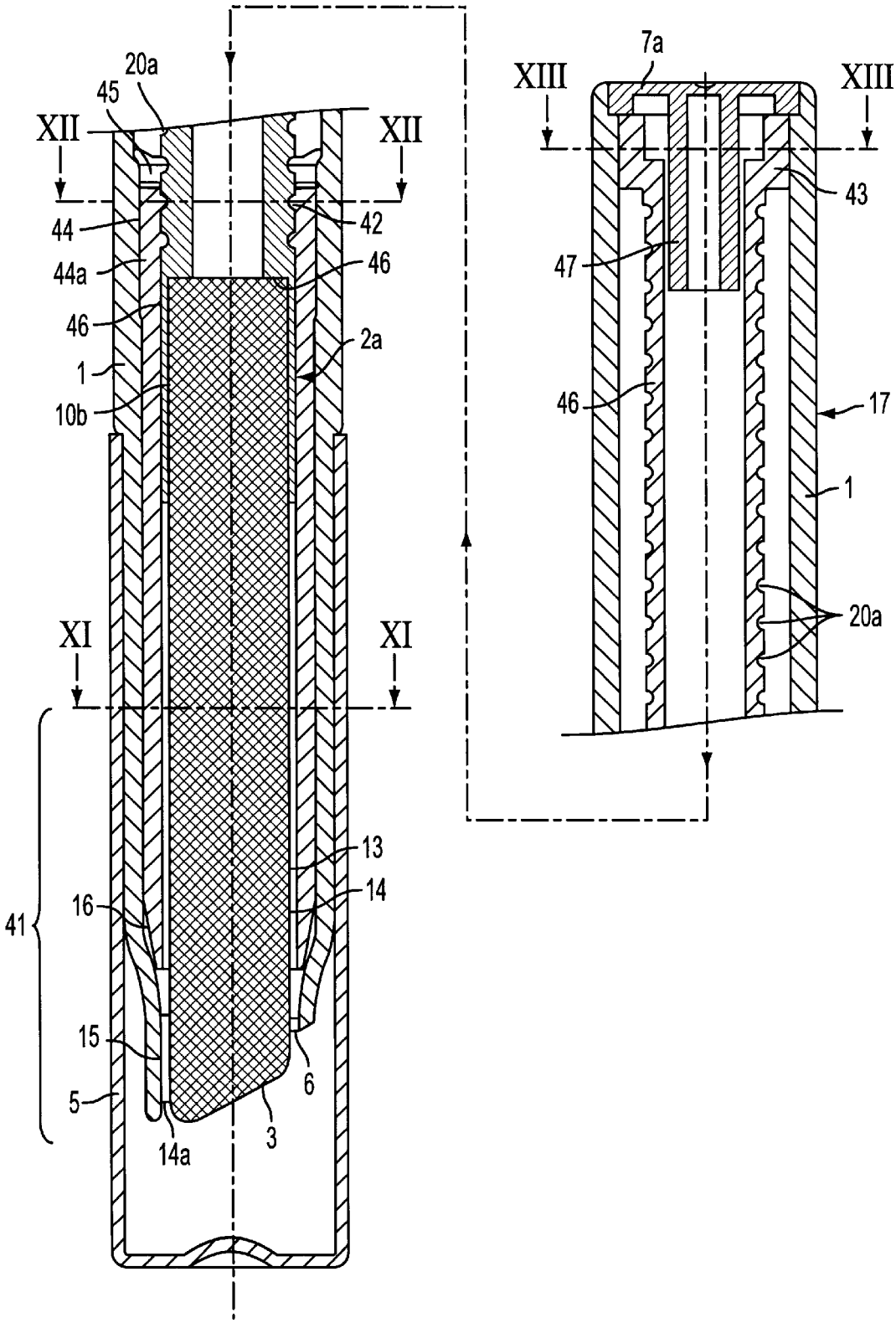
FIG. 10 is a longitudinal section through a further embodiment of a pencil.
Figure 11:
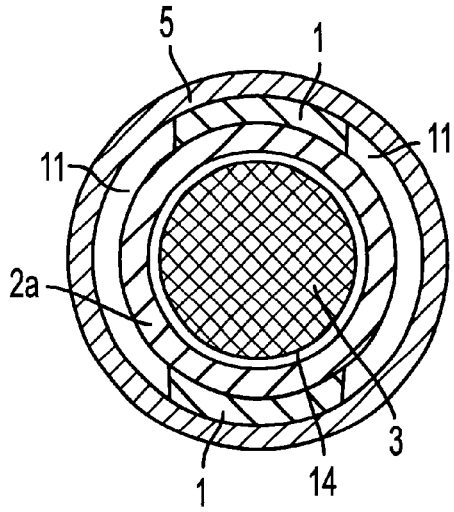
FIG. 11 is a cross-section along the line XI—XI in FIG. 10.
Figure 12:
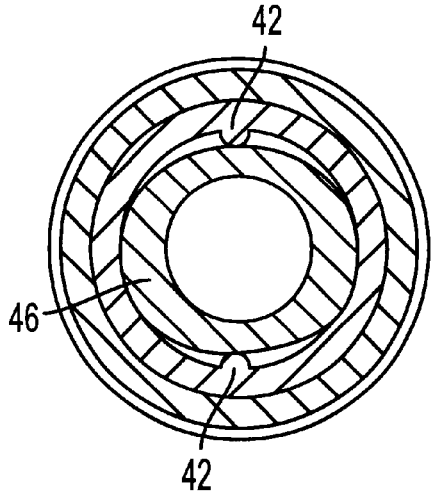
FIG. 12 is a cross-section along the line XII—XII in FIG. 10.
Figure 13:
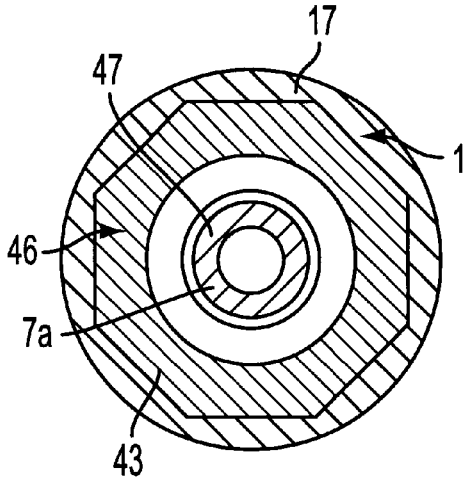
FIG. 13 is a cross-section along the line XIII—XIII in FIG. 10.

The pencil illustrated in FIG. 10 is a lip liner pencil. The front region 41 is configured as is the lip liner pencil according to FIG. 1, as described above. In contrast to the pencil illustrated in FIG. 1, the rotating sleeve 2*a* extends only in the front section of the pencil body 1. Two diametrically-opposite latching protrusions 42 extend radially inward from the rear end of the rotating sleeve, and engage an outside thread 20*a* of the essentially tubular core-driving part 4*b*. The outside thread 20*a* extends over the rear part of the core-driving part 4*b* extending into the rear section 17 of the pencil body. The core-driving part 4*b* has at its rear end a radially-widened guide section 43. The outer circumferential surface of the guide section 43 has an octagonal cross section, and is surrounded with torsional lockup by the inner surface of the rear section 17 of the pencil body 1, which is likewise octagonal. In the region of the rear end of the rotating sleeve 2*a*, the pencil body 1 has a radially-widened fixing region 44, into which a correspondingly radially-widened extension section 44*a* of the rotating sleeve 2*a* extends. In this way, the rotating sleeve 2*a* is rotatably and axially fixed in the front part of the pencil body 1. The rear end of the fixing region 44 is formed by an annular protrusion 45 projecting radially inward from the inner surface of the pencil body 1. The adjoining region extending from this annular protrusion up to the rear end of the pencil body has a larger diameter than the region of the pencil body 1 disposed in front of the annular protrusion 45. The core-retaining part 10*b* has a thinner wall than the rest of the region of the core-driving part 4*b*. A radially inward-projecting stop shoulder 46 that rests against the rear end face of the core 3 forms the transition between the walls of differing thickness. A plug 7*a* seals the rear end of the pencil body 1. This plug supports a central tube 47 that projects coaxially into the rear end of the core-driving part 4*b*.

If, starting from the position illustrated in FIG. 10, the rotating sleeve 2*a* is rotated in the corresponding direction, the core-driving part 4*b* moves toward the core opening 6. Because of the rotatably-fixed guidance of the core-driving part 4*b* in the rear section 17 of the pencil body 1, the core 3 moves, rotatably fixed with respect to the pencil body 1. In contrast, the rotating sleeve 2*a* rotates with respect to both the pencil body 1 and the core 3. The radial gap 14 or 14*a* between the core and the rotating sleeve 2 prevents a shearing of the core.

Figure 14:
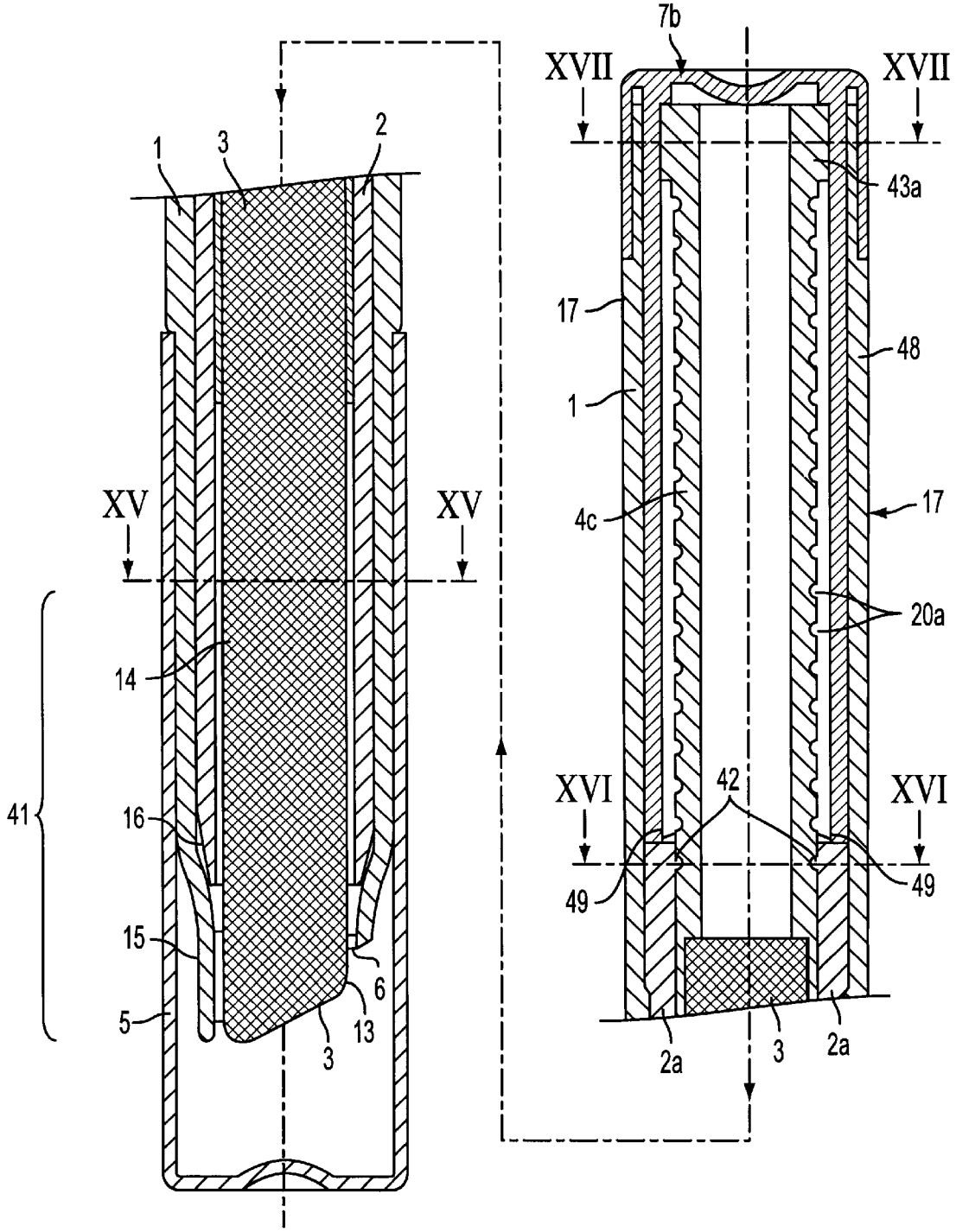
FIG. 14 i s a longitudinal section through a further embodiment of a pencil.
Figure 15:
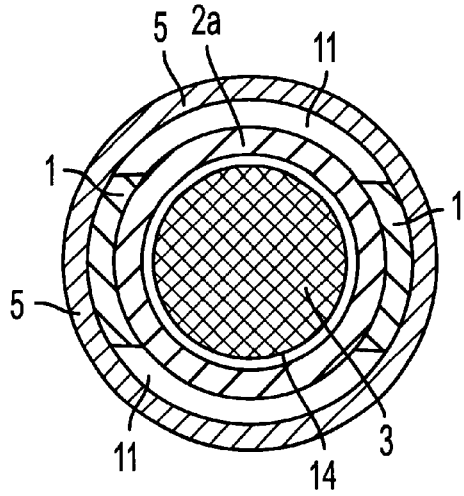
FIG. 15 is a cross-section along the line XV—XV in FIG. 14.
Figure 16:
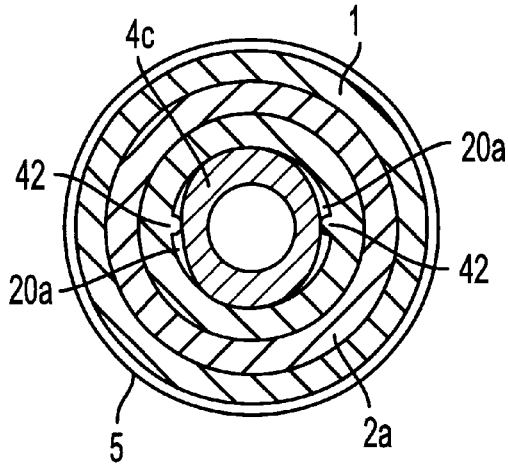
FIG. 16 is a cross-section along the line XVI—XVI in FIG. 14.
Figure 17:
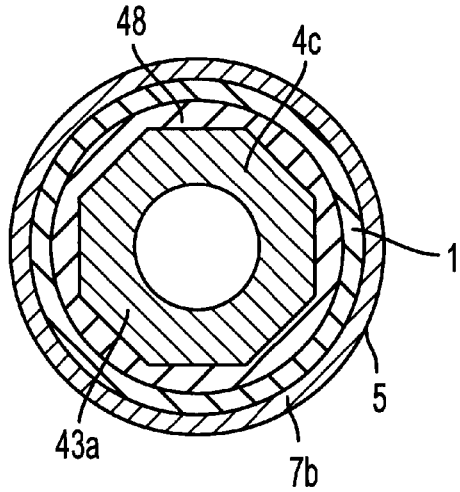
FIG. 17 is a cross-section along the line XVII—XVII.

The lip liner pencil shown in FIG. 14 basically differs from the one shown in FIG. 10 in that the sealing plug 7*b* has a spacing tube 48, which projects into the rear section 17 and coaxially surrounds the core-driving part 4*c* with radial spacing, and extends up to the rotating sleeve 2*a*. The end face 49 of its free end cooperates with the rear end face of the rotating sleeve 2*a* in the manner of an axial stop, and secures the rotating sleeve against an axial displacement toward the rear end of the pencil body 1. No radially-widened fixing region, such as is the case in the pencil body according to FIG. 10 is necessary, thus simplifying the manufacture of the pencil body in an injection-molding process. The tip region 41 of the pencil illustrated in FIG. 14 is embodied like that of the pencil according to FIG. 10. For a rotatably-fixed and axially-movable guidance of the core-driving part 4*c*, the guide section 43*a* does not cooperate with the inner surface of the rear section 17 of the pencil body 1, but with the inner surface of the spacing tube 48. The circumferential surface of the guide section 43*a* and the inner surface of the spacing tube 48, which both have an octagonal cross section, cooperate with torsional lockup and are axially displaceable. The function is basically the same as in the pencil according to FIG. 10.

It will be understood that the above description of the present invention is susceptible to various modifications, changes and adaptations, and the same are intended to be comprehended within the meaning and range of equivalents of the appended claims.

What is claimed is:

1. A pencil for a soft-core product comprising:

a sleeve-shaped pencil body having a first tip with an opening, a circumferential surface and a rear section;

a rotating sleeve having an end adjacent the rear section and a second tip opposite the end, the end of said rotating sleeve being axially fixed to said sleeve-shaped pencil body and arranged so that said rotating sleeve can rotate in the pencil body; and a core-retaining means for receiving and supporting an axially-movable soft-core product, said core-retaining means being arranged inside said rotating sleeve so that it can be moved back and forth in an axial direction owing to a relative movement between said pencil body and said rotating sleeve thereby axially moving the product through said opening of the pencil body, an outer circumferential surface of said core-retaining means cooperating with the inner surface of the rotating sleeve in the manner of an axial guide, wherein the rotating sleeve is arranged completely inside said pencil body and extends substantially to the opening in the first tip of the pencil body and the circumferential surface of the pencil body that encloses the rotating sleeve contains at least one actuation window.

2. A pencil according to claim 1, wherein said actuation window is disposed in the front section of said pencil body.

3. The pencil according to claim 1, wherein said rotating sleeve at least partly comprises transparent material in the region of said actuation window.

4. A pencil according to claim 1, wherein said rotating sleeve ends with axial spacing in front of the opening of the pencil body, and the inside diameter of the end region of said pencil body extends approximately from the end of said rotating sleeve to the opening correspondence to the inside diameter of the section of the rotating sleeve that surrounds the core product.

5. A pencil according to claim 1, wherein said rotating sleeve extends up to the opening of the pencil body.

6. A pencil according to claim 1, wherein a driving section of said rotating sleeve extends into the rear section of said pencil body, nearly up to its rear end, and coaxially surrounds a connecting sleeve that is disposed in the rear section, said connecting sleeve being guided inside the rotating sleeve to be rotatably fixed and axially movable, coaxially surrounding a threaded spindle that is disposed in said pencil body to be rotatably and axially fixed, and engages an outside thread of the threaded spindle, and a first end of the connected sleeve is connected to the core-driving part in an axially-effective manner.

7. A pencil according to claim 6, wherein there is a form-fit, which is effective in the direction of rotation, between said drive section and at least one longitudinal section of said connecting sleeve.

8. A pencil according to claim 6, wherein said threaded spindle has the shape of a hollow cylinder and surrounds a guide rod that extends away from the rear end of the core-driving part, coaxially to the center longitudinal axis of the pencil body, said spindle fixing said rod against relative rotation, and said connecting sleeve being rotatably fixed to the core-driving part.

9. A pencil according to claim 8, wherein there is a form-fit, which is effective in the direction of rotation, between said front end, said threaded spindle and said guide rod.

10. A pencil according to claim 1, further comprising a driving section of the rotating sleeve which extends into the rear section of the pencil body, a core-driving part coaxially disposed inside the driving section of said rotating sleeve, and a threaded spindle wherein the core-driving part is essentially tubular, is rotatably fixed to the rotating sleeve and rotates therewith axially moving said core-retaining means, the core-driving part coaxially surrounding the threaded spindle that is rotatably and axially fixed in the rear section of said pencil body, and the core-driving part engages an outside thread of the threaded spindle so that the core-driving part axially moves as a result of rotation of the rotating sleeve.

11. A pencil according to claim 10, wherein said core-driving part has a plurality of form-fit protrusions which project into the driving section of said rotatable sleeve so that a form-fit is formed between said driving section of said rotating sleeve and at least one longitudinal section of the core-driving part thereby enabling the core-driving part to be rotatably fixed to the rotating sleeve.

12. A pencil according to claim 10, wherein the rear end of the core-driving part is provided with longitudinal slots, thereby forming a plurality of spring tongues at least one of which has a radially inward-oriented protrusion that cooperates with the outside thread of the threaded spindle.

13. A pencil according to claim 1, wherein said rotating sleeve essentially extends only in a front section of said pencil body and cooperates with at least one protrusion that projects radially inward from its rear end, with an outside thread of the core-driving part that is guided to be rotatably fixed and axially movable inside the rear section of said pencil body, in the manner of a spindle gear.

14. A pencil according to claim 13, further comprising a guide section disposed at the rear end of the core-driving part and having a larger outside diameter, said guide section cooperating with the rear section of said pencil body, with torsional lockup.

15. A pencil according to claim 14, further comprising a tube whose inside surface cooperates, with torsional lockup, with the guide section is disposed in the rear section of said pencil body so as to be rotatably and axially fixed.

16. A pencil according to claim 15, wherein said tube extends up to the rotating sleeve, and cooperates with it in the manner of an axial stop.

17. A pencil according to claim 15, wherein said tube is part of a plug that seals the rear end of said pencil body.

18. A pencil as in claim 1, wherein the soft-core product is a cosmetic product.

19. A pencil as in claim 1, further comprising a protective cap which covers the first tip of the pencil body and the at least one actuation window.

* * * * *